US007581767B2

(12) United States Patent
Fujihara

(10) Patent No.: US 7,581,767 B2
(45) Date of Patent: Sep. 1, 2009

(54) DOOR CLOSING DEVICE

(75) Inventor: Yoshihiko Fujihara, Kai (JP)

(73) Assignee: Mitsui Mining and Smelting Co., Ltd. (JP)

( * ) Notice: Subject to any disclaimer, the term of this patent is extended or adjusted under 35 U.S.C. 154(b) by 0 days.

(21) Appl. No.: 11/465,618

(22) Filed: Aug. 18, 2006

(65) Prior Publication Data

US 2007/0040391 A1 Feb. 22, 2007

(30) Foreign Application Priority Data

Aug. 19, 2005 (JP) ..... 2005-238207

(51) Int. Cl.
*E05C 3/06* (2006.01)

(52) U.S. Cl. ..... 292/201; 292/216; 292/DIG. 23

(58) Field of Classification Search ..... 292/201, 292/216, DIG. 23, DIG. 42
See application file for complete search history.

(56) References Cited

U.S. PATENT DOCUMENTS 5,466,021 A 11/1995 Ishihara et al.
6,131,967 A * 10/2000 Kondo et al. ..... 292/201
6,223,468 B1 * 5/2001 Kobayashi ..... 49/280
6,279,361 B1 * 8/2001 Baukholt et al. ..... 70/279.1
6,280,592 B1 * 8/2001 Mastrofrancesco et al. . 204/485
6,494,505 B2 * 12/2002 Kobayashi et al. ..... 292/201
6,698,804 B2 * 3/2004 Shiota et al. ..... 292/201
2001/0005079 A1 * 6/2001 Takamura ..... 292/201
2002/0030366 A1 * 3/2002 Swan ..... 292/201
2002/0117862 A1 * 8/2002 Yamauchi et al. ..... 292/201
2003/0067175 A1 * 4/2003 Shiota et al. ..... 292/201
2005/0167991 A1 * 8/2005 Yoneyama ..... 292/201
2006/0170224 A1 * 8/2006 Mitchell et al. ..... 292/216
2006/0290142 A1 * 12/2006 Tani et al. ..... 292/201

* cited by examiner

*Primary Examiner*—Peter M Cuomo
*Assistant Examiner*—Kristina R Fulton
(74) *Attorney, Agent, or Firm*—Ostrolenk Faber LLP

(57) ABSTRACT

A latch engages with a striker fixed to a vehicle when a door of the vehicle is closed. A latch lever that turns together with the latch has an engagement portion. A closing lever forced by a spring has a pressing portion and has the same axis as a sector gear driven by a motor. If the door is incompletely closed or in a half-latched position, the closing lever turns by the sector gear driven by the motor, so that the pressing portion contact and press the engagement portion of the latch lever to allow the door to close completely. Even if the pressing portion inadvertently engages with the engagement portion, the sector gear and the closing lever can return to the original position independently. Then, the door can normally be closed.

2 Claims, 9 Drawing Sheets

DOOR CLOSING DEVICE

BACKGROUND OF THE INVENTION

The present invention relates to a door closing device in a vehicle and particularly to a door closing device in a vehicle, having a latch engagable with a striker of the vehicle to enable the latch to move from a half-latched position to a full-latched position.

In a conventional door closing device, for example, as disclosed in U.S. Pat. No. 5,466,021A to Ishihara et al., closing of a door allows a latch engagable with a striker fixed to a vehicle to move from an open position to a half-latched position. A half-latch detecting sensor detects the half-latched position to enable a passive lever to move from an original position in a closing direction by a motor thereby moving the latch in the half-latched position to a full-latched position with the move to the closing direction. After the latch is moved to the full-latched position, the passive lever is reversely rotated towards the original position by the motor.

However, in the door closing device in the US patent, for example, owing to wrong detection of the half-latch detecting sensor, the latch is moved from the open position to the full-latched position after the passive lever is moved from the original position in the closing direction by the motor. The latch engages with the passive lever to make it impossible for the passive lever to return to the original position. Such wrong operation is likely to cause damage such as deformation on the engagement portion to result in malfunction in the operation.

Also, in the structure in which the latch can be released from a striker by moving the passive lever from the original position to the releasing direction opposite to the closing direction, wrong operation likely makes the door difficult to open.

SUMMARY OF THE INVENTION

In view of the disadvantages in the prior art, it is an object of the invention to provide a door closing device that prevents each part from being damaged even if wrong operation occurs, making normal operation more secure.

BRIEF DESCRIPTION OF THE DRAWINGS

The features and advantages of the invention will become more apparent from the following description with respect to embodiments as shown in the accompanying drawings wherein.

DETAILED DESCRIPTION OF PREFERRED EMBODIMENTS

Figure 1:
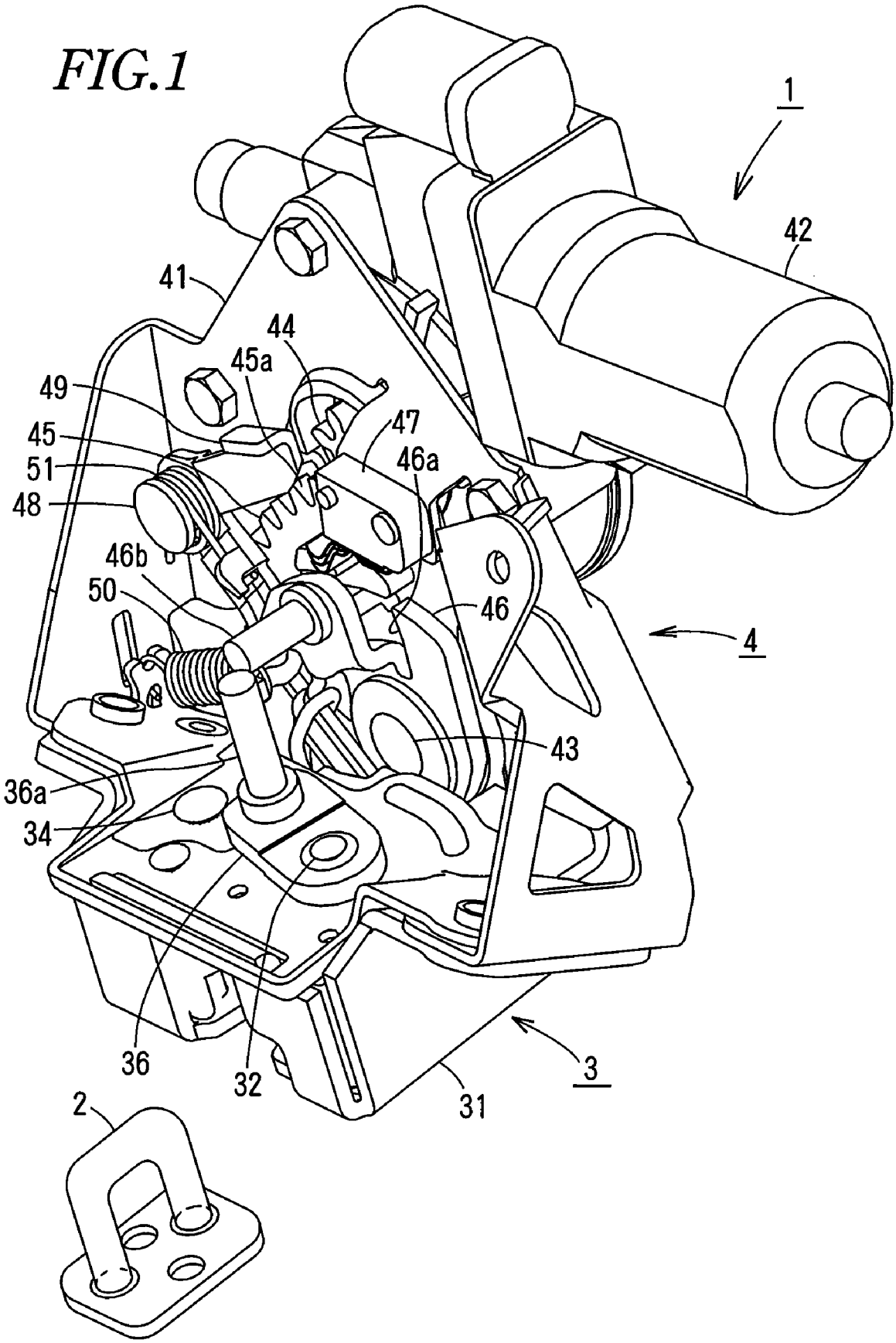
FIG. 1 is a perspective view of a door closing device according to the present invention.

An embodiment of the present invention will be described with respect to FIGS. 1 to 13. In the description below, the left lower side in FIG. 1, front in FIG. 2 and lower side in FIG. 3 are deemed the front, while the right upper side in FIG. 1, reverse side in FIG. 2 and upper side in FIG. 3 are deemed the rear.

A door closing device is provided at the lower end of a tailgate (not shown) hinged on a shaft (not shown) at the upper end on the back of a vehicle to enable the tailgate to open or close up and down. The door closing device comprises an engagement portion 3 that engages with a striker 2 fixed to a vehicle to hold the tailgate in a closed position, and a closing portion 4 thereby enabling the tailgate to move from an incompletely-closed position to a full-closed position by a motor 42.

Figure 4:
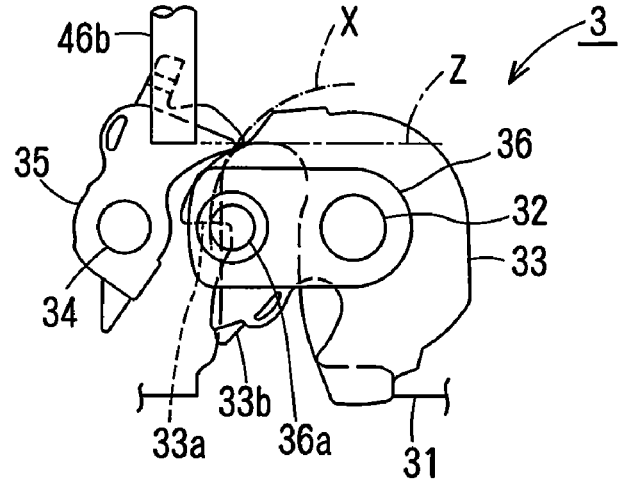
FIG. 4 is a plan view of the engagement structure when a latch is in an open position.
Figure 5:
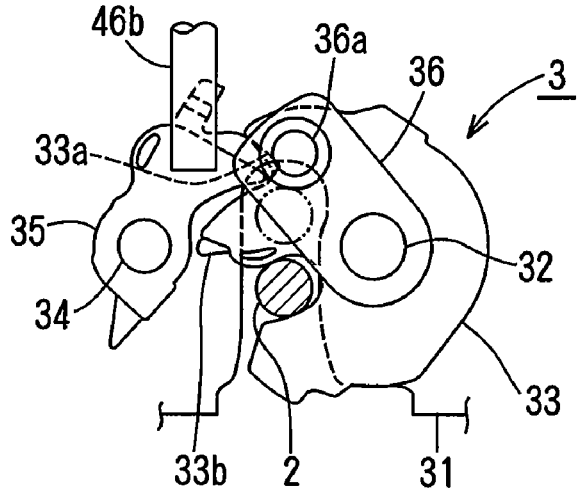
FIG. 5 is a plan view of the engagement structure when the latch is in a half-latched position.
Figure 6:
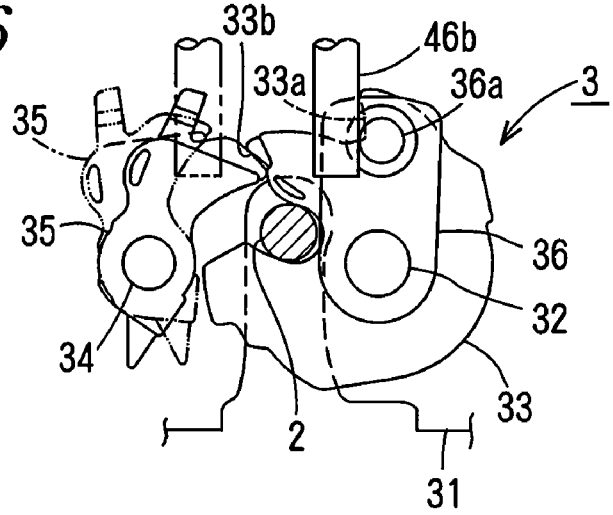
FIG. 6 is a plan view of the engagement structure when the latch is in a full-latched position.
Figure 7:
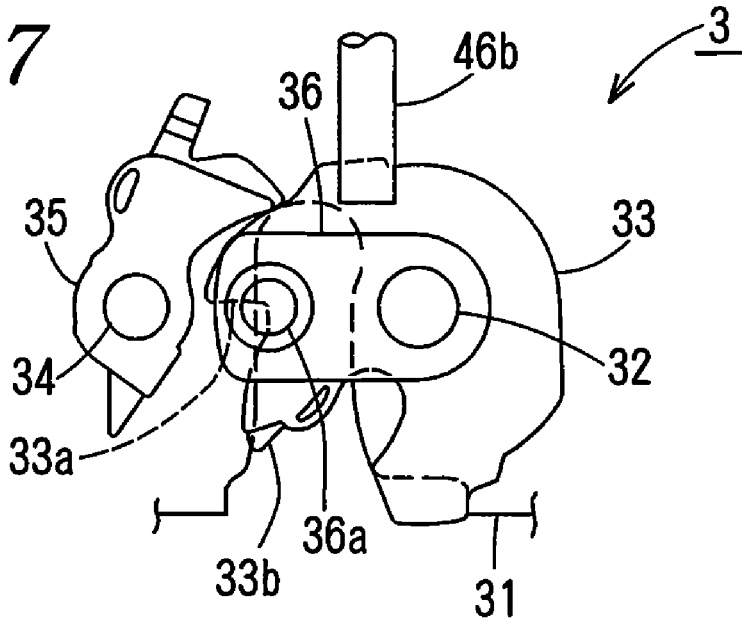
FIG. 7 is a plan view of the engagement structure when the latch is in an open position in malfunction.
Figure 8:
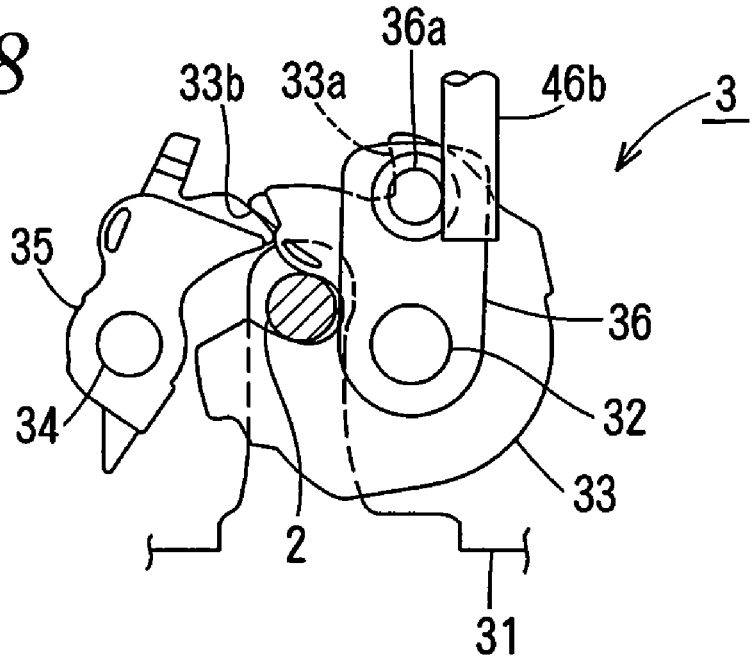
FIG. 8 is a plan view of the engagement structure when the latch is in a full-latched position in malfunction.

FIGS. 4-6 are plan views showing normal operation of the engagement portion 3, and FIGS. 7 and 8 show abnormal operation thereof. The engagement portion 3 comprises a box-like latch housing 31 fixed to the lower end of the tailgate; a latch 33 pivoted to a vertical pivot 32 in the latch housing 31 to engage with the striker 2; a locking plate 35 pivoted on a vertical pivot 34 in the latch housing 31; and a latch lever 36 that can turn on the pivot 32 together with the latch 33.

Figure 3:
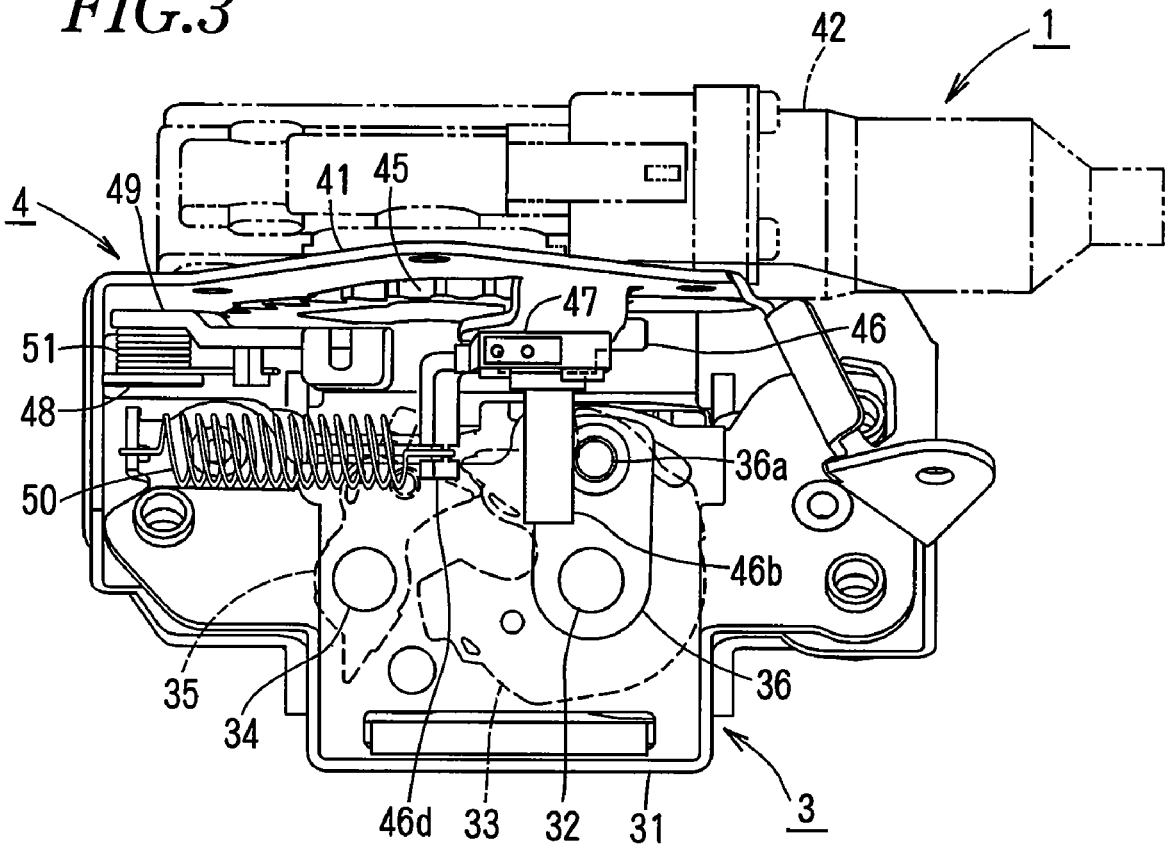
FIG. 3 is a plan view of the door closing device.

As the tailgate is closed, the latch 33 turns from an open position in FIGS. 4 and 7 in which the latch 33 disengages from the striker 2 to allow the tailgate to open, to a full-latched position in FIGS. 3, 6 and 8 in which the latch 33 completely engages with the striker 2 to allow the tailgate to close completely, via a half-latched position in FIG. 5 in which the latch 33 incompletely engages with the striker 2 to allow the tailgate to close imcompletely.

The latch lever 36 has a cylindrical engagement portion 36*a* projecting upwards from a free end and rotates together with the latch 33 from the open position in FIGS. 4 and 7 to the full-latched position in FIGS. 3, 6 and 8 via the half-latched position in FIG. 5.

The engagement portion 36*a* is positioned at the side of the pivot 32 when the latch 33 is in the open position, turns at about 45 degrees rearwards from the open position in the half-latched position, and is positioned right behind the pivot 32 in the full-latched position. The engagement portion 36*a* may be provided without the latch lever 36.

The locking plate 35 is forced by a spring (not shown) in an engagement direction or in a clockwise direction in FIGS. 4-8 to engage with a half-latching pawl 33*a* or a full-latching pawl 33*b* of the latch 33 by the spring owing to turning of the latch with closing of the tailgate.

As shown in FIG. 5, when the latch 33 turns in the half-latched position, the locking plate 35 engages on the half-latching pawl 33*a* to prevent the latch 33 from turning from the half-latched position to the open position thereby keeping the tailgate closed imcompletely. When the latch 33 turns in the full-latched position, the locking plate 35 engages on the full-latching pawl 33*b* in FIG. 6 to hold the latch 33 in the full-latched position holding the tailgate in the full-closed position. The locking plate 35 turns against the force of the spring to the releasing position shown by an imaginary line in FIG. 6 to move away from the half-latching pawl 33*a* or full-latching pawl 33*b* to allow the latch 33 to disengage from the striker 2 enabling the tailgate to open.

Figure 9:
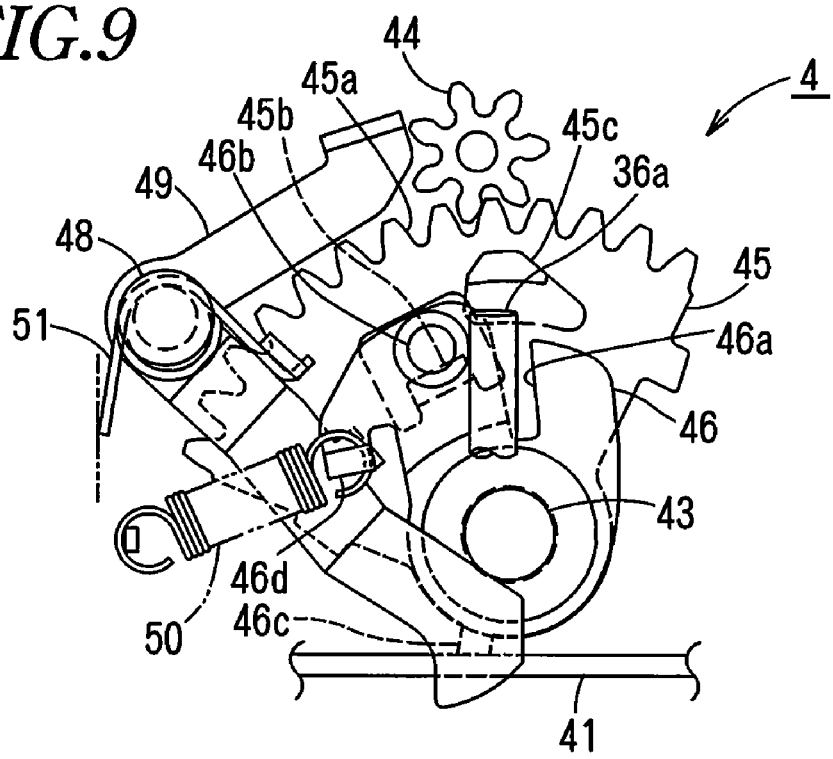
FIG. 9 is a front view of a closing portion when a sector gear and a closing lever are in an original position.
Figure 10:
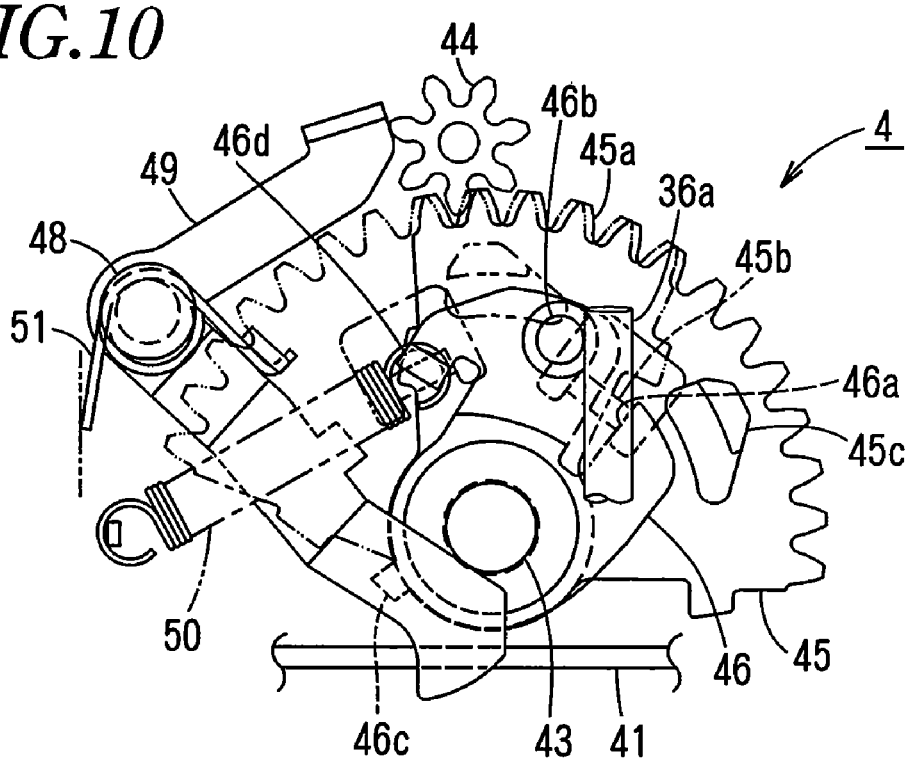
FIG. 10 is a front view of the closing portion when the sector gear and closing lever are moved in a closing direction.
Figure 11:
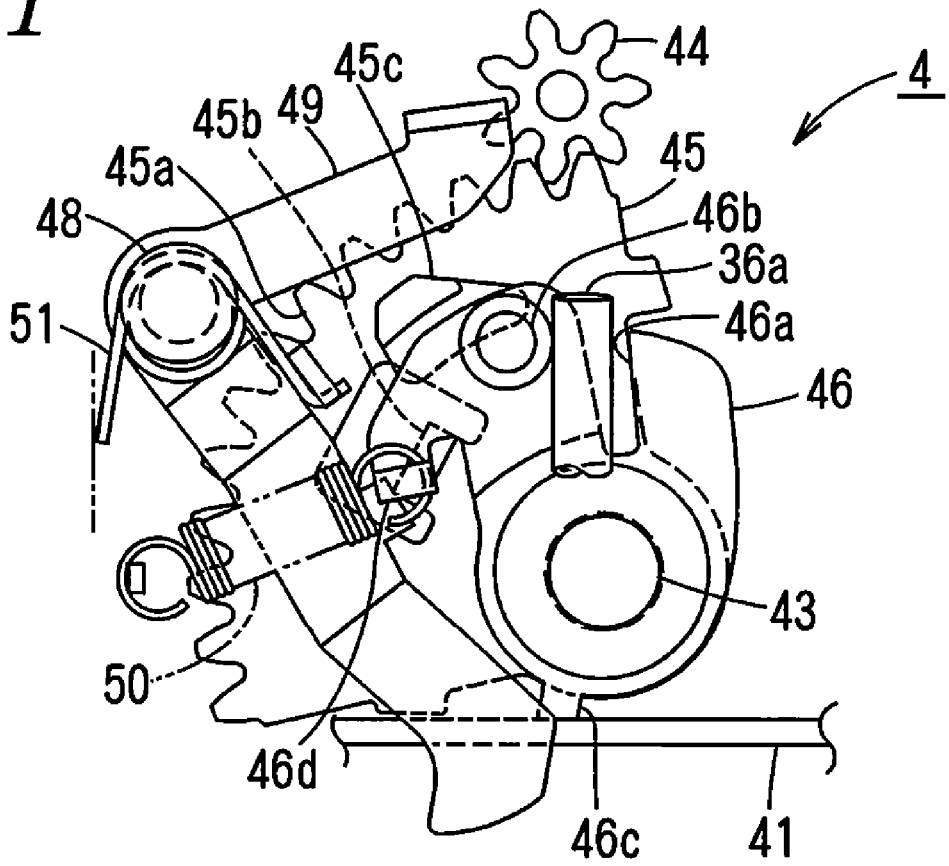
FIG. 11 is a front view of the closing portion when the sector gear is moved in a releasing direction.
Figure 12:
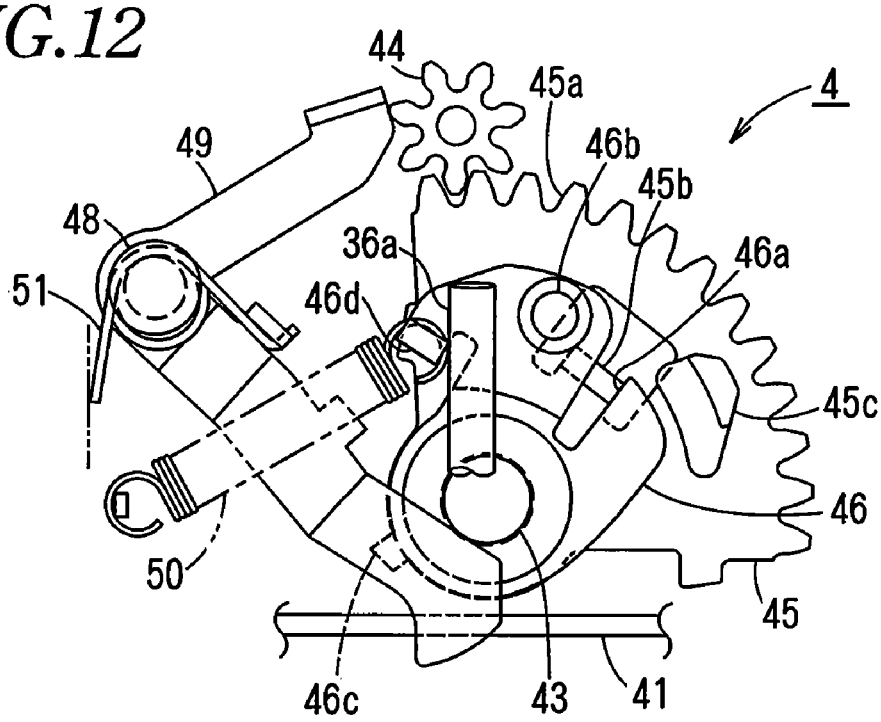
FIG. 12 is a front view of the closing portion at the beginning of malfunction.
Figure 13:
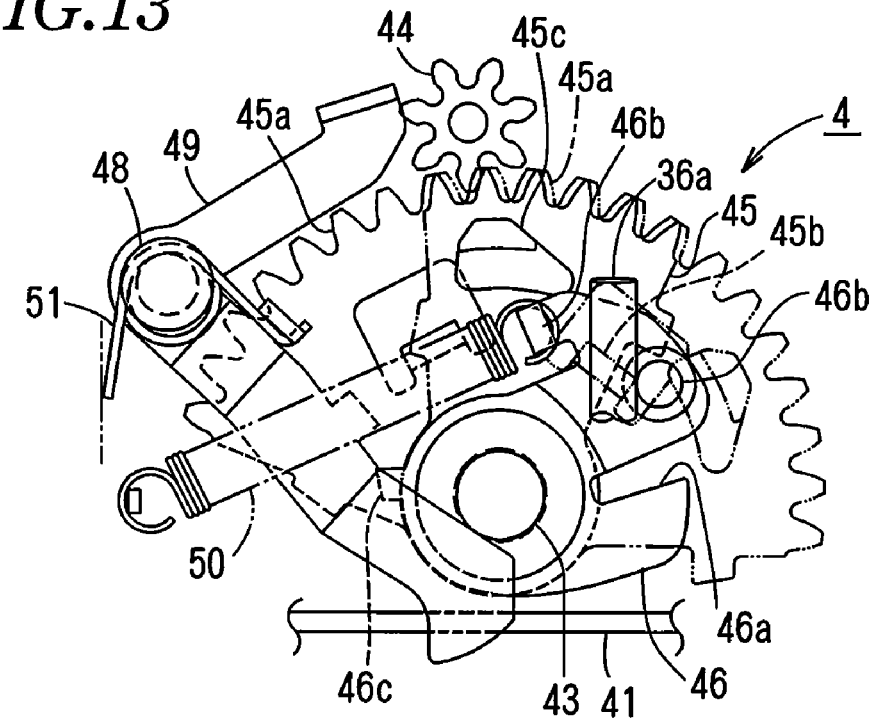
FIG. 13 is a front view of the closing portion in malfunction.

FIGS. 9-11 are front views of the closing portion 4 during normal operation and FIGS. 12 and 13 are front views thereof during abnormal operation. The closing portion 4 comprises a motor 42 fixed on the upper part of the base plate 41 fixed to the rear part of the latch housing 31; a sector gear 45 as driving member pivoted on a pivot 43 in front of the base plate 41 to mesh with a pinion gear 44 which reduces the speed of the rotation of the motor 42; a closing lever 46 pivoted on the pivot 43 to rotate independently from the sector gear 45; a spring 50 that enables the closing lever 46 to return to an original position described later; an opening lever 49 pivoted on a pivot 48 on the front surface of the base plate 41; and an original position detecting sensor 47 detecting the original position of the sector gear 45 described later.

Figure 2:
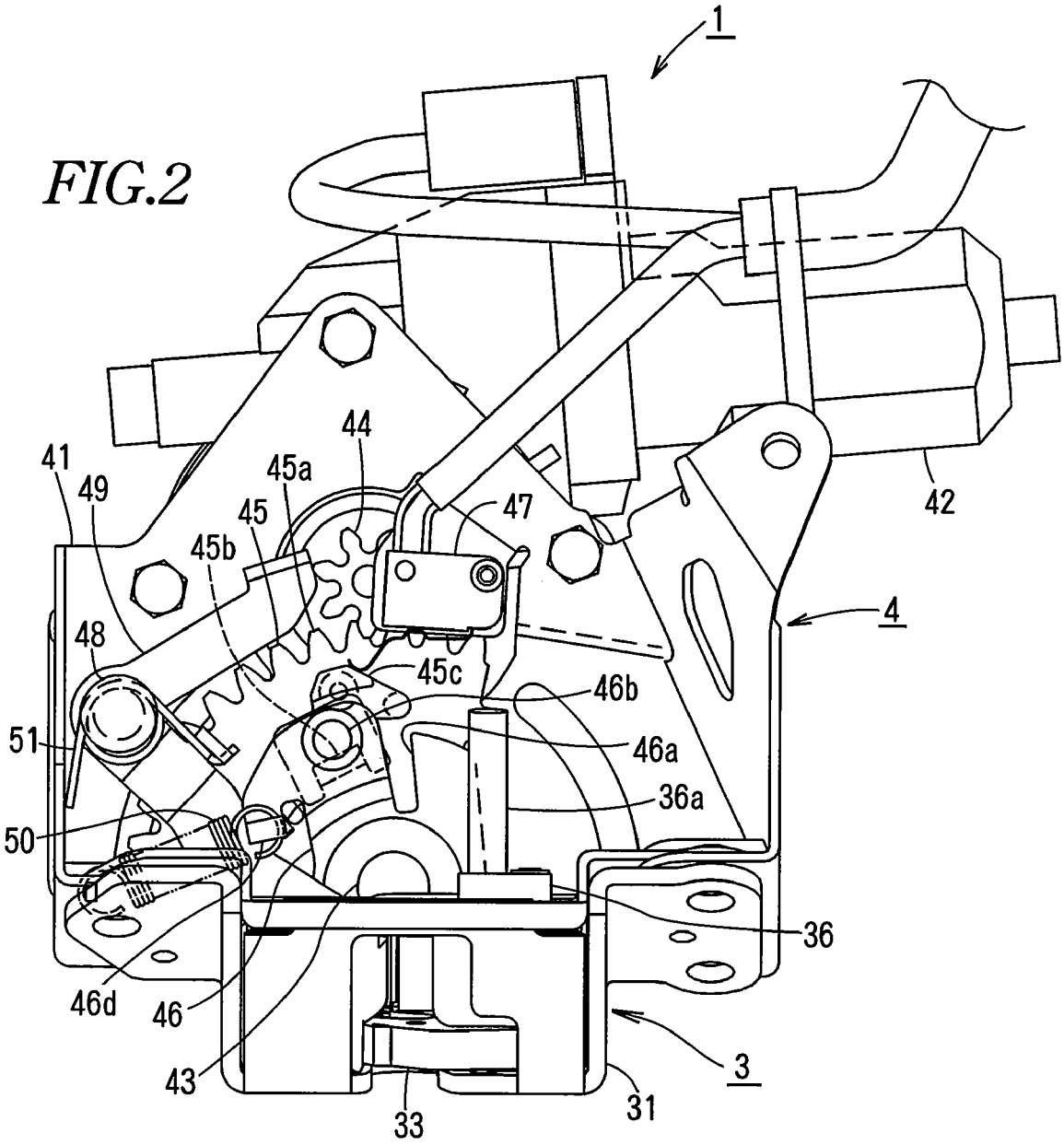
FIG. 2 is a front elevational view of the door closing device.

The sector gear 45 comprises a plurality of teeth 45*a* meshing with the pinion gear 44; a projection 45*b* that protrudes forwards horizontally; and an original position detecting portion 45*c*, and normally held in the original position in FIGS. 2 and 9.

With closing of the tailgate, when the half-latched position of the latch 33 is detected by a half-latch detecting sensor (not shown), the motor 42 is controlled in a normal rotation, by which the sector gear 45 turns from the original position in a closing direction or in a clockwise direction in FIGS. 2 and 9. When the full-latched position of the latch 33 is detected by a full-latch detecting sensor (not shown), the motor is controlled in a reverse direction thereby allowing the sector gear 45 to turn reversely toward the original position. The original position detecting portion 45*c* gets in touch with the original position detecting sensor 47 to detect the original position of the sector gear 45 to enable reverse rotation control of the motor 42 to stop thereby allowing the sector gear 45 to stop at the original position.

When operation of a handle (not shown) for opening the tailgate is detected, the motor 42 is controlled reversely. As shown in FIG. 11, the sector gear 45 rotates from the original position in a releasing direction opposite to the closing direction, and the motor 42 is controlled reversely to turn toward the original position. The original position detecting portion 45*c* contacts the original position detecting sensor 47 to detect the original position of the sector gear 45 thereby stopping reverse control of the motor 42, so that the sector gear 45 stops at the original position.

The closing lever 46 has a contacted portion 46*a* which can contact the projection 45*b* with rotation of the sector gear 45 in the closing direction; and a cylindrical pressing portion 46*b* which can contact the engagement portion 36*a* if the latch 33 and the latch lever 36 are in the half-latched position. With rotation of the sector gear 45 in the closing direction, the pressing portion 46*b* moves from the original position in FIG. 9 outside the track of the engagement portion 36*a* in the closing direction or clockwise direction in FIG. 9 to enable the pressing portion 46*b* to contact the left-side part of the engagement portion 36*a* thereby moving the latch 33 from the half-latched position to the full-latched position. When the latch 33 is moved by the closing lever 46 from the half-latched position to the full-latched position in the normal operation, the closing lever 46 moves to the closing position in FIG. 10 where the pressing portion 46*b* contacts the left-side part of the engagement portion 36*a*.

If malfunction occurs as described later, the pressing portion 46*b* of the closing lever 46 contacts right-side part of the engagement portion 36*a* to move to an exceeding position in FIG. 13 beyond the closed position. When the closing lever 46 is in the original position, a stopper portion 46*c* at the lower part of the closing lever 46 contacts the base plate 41 thereby preventing the closing lever 46 from turning in an opposite direction to the closing direction.

One end of the spring 50 engages with the stationary base plate 41 or latch housing 31 by which the closing lever 46 is supported, and the other end of the spring 50 engages with an engagement portion 46*d* of the closing lever 46 to apply force to the closing lever in an anticlockwise direction to return to the original position.

The positional relationship between the pressing portion 46*b* of the closing lever 46 and the engagement portion 36*a* of the latch lever 36 will be described with respect to FIG. 4.

When the closing lever 46 is in the original position, the pressing portion 46*b* goes out of a moving track X of the engagement portion 36*a* when the latch lever 36 moves from the open position to the full-latched position and vice versa, and the closing lever 46 moves in a closing direction to enable the pressing portion 46*b* to invade the track X. When the latch 33 is in the open position, the engagement portion 36*a* goes out of a moving track Z of the pressing portion 46*b*, while the latch 33 moves into the half-latched position to allow the engagement portion 36*a* to come into the moving track Z.

The opening lever 49 is kept in a waiting position in FIGS. 2, 9, 10 and 12 by the spring 51 wound on the pivot 48. With rotation of the sector gear 45 in a releasing direction, the opening lever 49 turns from the waiting position to the releasing position in FIG. 11 against the force of the spring 51 to turn the locking plate 35 to the releasing position which allows the latch 33 to disengage from the striker 2 to enable the tailgate to open.

Then, normal operation will be described. When the tailgate closes, the latch 33 and latch lever 36 turn from the open position in FIG. 4 to the half-latched position in FIG. 5 enabling the engagement portion 36*a* to come into the moving track Z of the pressing portion 46*b* and enabling the locking plate 35 to engage with the half-latching pawl 33.a to prevent the latch 33 from turning along the opening direction. When the half-latched position of the latch 33 is detected by a half-latch detecting sensor (not shown), the sector gear 45 is rotated from the original position in FIG. 9 in the closing direction by the motor 42 to allow the engaging portion 45*b* to press the engaged portion 46*a* of the closing lever 46 enabling the closing lever 46 to move in the closing direction against the force of the spring 50.

With the movement of the closing lever 46 in the closing direction, the pressing portion 46*b* contacts the engagement portion 36*a* in the closed position in FIG. 10, so that the latch 33 and latch lever 36 turns from the half-latched position to the full-latched position in FIG. 6.

The latch 33 turns to the full-latched position to allow the locking plate 35 to contact the full-latching pawl 33*b* to hold the latch 33 in the full-latched position. Then, with the full-latch detecting sensor (not shown), the full-latched position of the latch 33 is detected, so that the motor 42 is reversely controlled. With the driving force, the sector gear 45 reversely turns to return to the original position. Following the operation, the closing lever 46 returns to the original position by the spring 50.

In a full-closed position of the tailgate or when the latch 33 is in a full-latched position and when the locking plate 35 engages on the full-latching pawl 33*b* in FIG. 6, the door handle of the tailgate is operated and the motor 42 is reversely controlled. By the driving force, as shown in FIG. 11, the sector gear 45 turns in a releasing position from the original position to allow the engaging portion 45*b* to contact the opening lever 49 to turn the opening lever 49 to the releasing position in FIG. 11. On the basis of the rotation of the opening lever 49, the locking plate 35 turns to the releasing position to disengage from the full-latching pawl 33*b* and to make the latch 33 freely turn in the opening direction thereby allowing the latch 33 to disengage from the striker 2 to enable the tailgate to open.

For example, owing to malfunction or wrong detection of the half-latch detecting sensor when the tailgate is closed, the sector gear 45 and the closing lever 46 are moved from the original position to the closing position by the motor 42. Thereafter, with respect to FIGS. 7, 8, 12 and 13, it will be described how to operate the latch 33 and the latch lever 36 when they turns from the open position to the full-latched position.

In this case, as shown in FIG. 7, before the latch 33 and the latch lever 36 moves to the half-latched position, the pressing portion 46*b* of the closing lever 46 comes into the track Z of the engagement portion 36a. So when the tailgate is closed in this state, the engagement portion 36*a* contact the left side of the pressing portion 46*b* with rotation of the latch 33 from the open position to the full-latched position to allow the latch 33 to contact the full-latching pawl 33*b* in FIGS. 8 and 13 resulting in malfunction not to allow the closing lever 46 to return to the original position. The sector gear in the closed position is shown by an imaginary line in FIG. 13.

However, even if malfunction in which the closing lever 46 is prevented from returning to the original position occurs, the closing lever 46 is movable to an exceeding position in FIG. 13 beyond the closed position against the force of the spring 50 with turning of the latch 33 thereby allowing the sector gear 45 to return to the original position shown by the solid line in FIG. 13 without damaging to each part owing to the reverse rotation control of the motor 42.

Furthermore, in the malfunction, when the tailgate is completely closed, reverse rotation control of the motor 42 by the operating handle allows the sector gear 45 to turn from the original position in the releasing direction thereby opening the tailgate. When the tailgate opens, the latch 33 turns from the full-latched position to the open position to allow the engagement portion 36*a* to go out of the track Z of the pressing portion 46*b* enabling the closing lever 46 to move to the original position by the spring 50. So both of the sector gear 45 and the closing lever 46 returns to the original position or normal condition.

Figure 14:
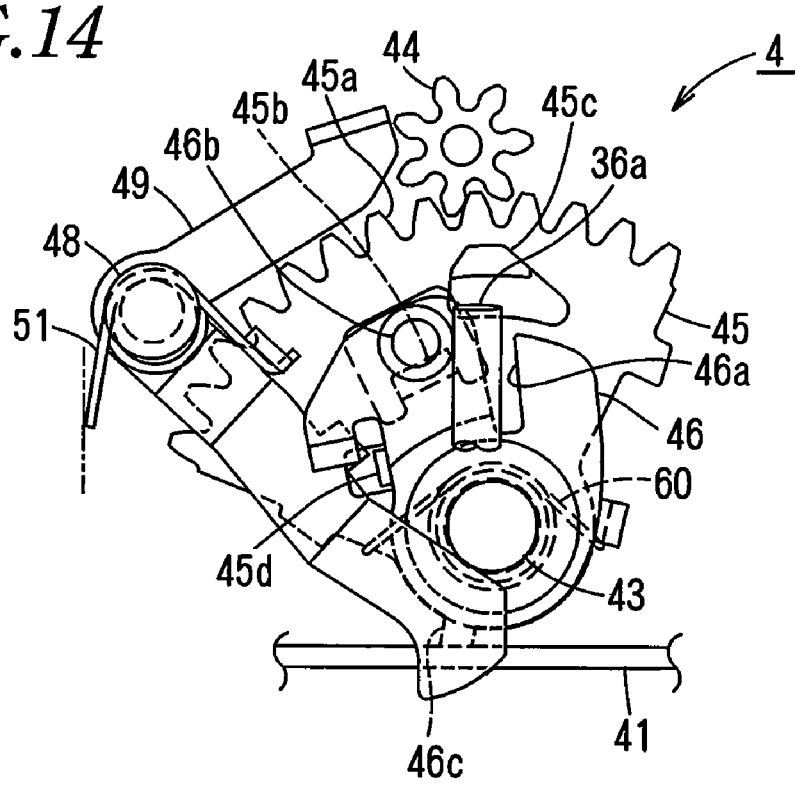
FIG. 14 is a front view of the closing portion in another embodiment.
Figure 15:
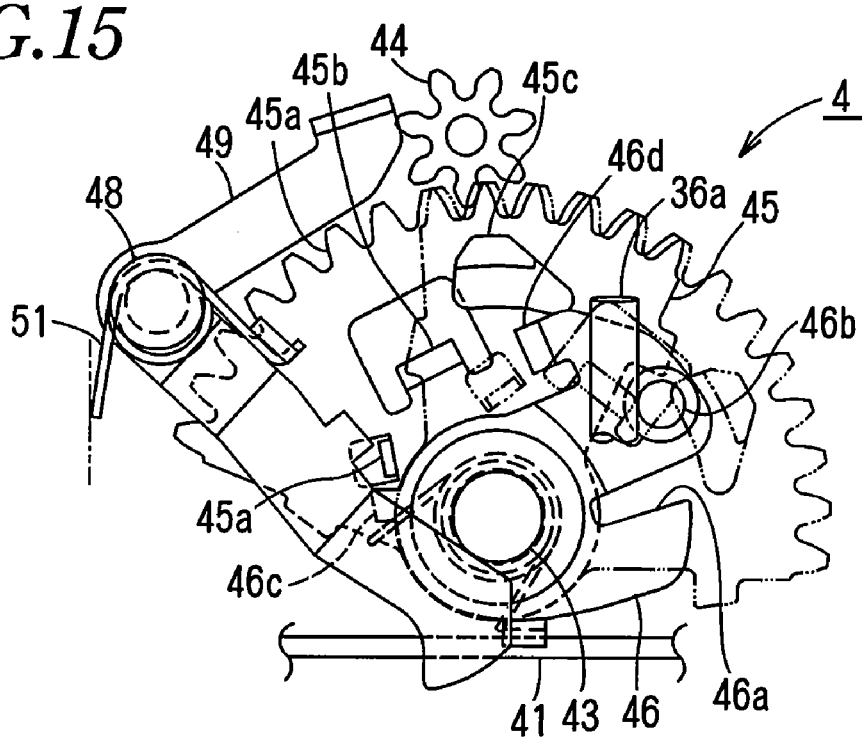
FIG. 15 is a front view of the closing portion in malfunction in the embodiment in FIG. 14.

FIGS. 14 and 15 show another embodiment of the present invention. In this embodiment, instead of the spring 50 for forcing the closing lever 46 to the original position, a spring 60 is provided. One end of the spring 60 engages with the sector gear 45, while the other end engages with the closing lever 46. The closing lever 46 urges the sector gear 45 in an anticlockwise direction. The other structure is the same as those of the foregoing embodiment and the same numerals are assigned to the same members of the foregoing embodiment. Its description is omitted.

Normally, a closing lever 46 is kept to contact a stopper 45*d* of a sector gear 45 by a spring 60 to rotate together with the sector gear 45. Thus, when the sector gear 45 turns in a closing direction, the closing lever 46 and spring 60 operates with the sector gear 45, so that force by the spring 60 does not act as resistance during normal operation.

As mentioned above, if wrong detection of a half-latched sensor allows the engagement portion 36*a* to contact a pressing portion 46*b* to prevent the closing lever 46 from returning to the original position, the sector gear 45 turns reversely against the force of the spring 60 from a position shown by an imaginary line to the original position shown by a solid line while the closing lever 46 is prevented from returning to the original position in FIG. 15. And the latch 33 turns to an open position to allow a engagement portion 36*a*to go out of the track Z of a pressing portion 46*b* enabling the closing lever 46 to return to the original position by the spring 60.

The foregoing merely relate to embodiments of the present invention. Various modifications and changes may be made without departing from the scope of claims. For example, (i) the driving member may be a rack that moves linearly by the motor 42 instead of the sector gear 45, and/or (ii) the present invention may be applied to a swinging side door or a slide door.

What is claimed is:

1. A door closing device comprising:

a latch housing;

a latch positioned in the latch housing, the latch being engagable with a striker mounted to a vehicle;

a latch lever positioned on the latch housing, the latch lever being connected to the latch and turning together with the latch, the latch lever having an engagement portion;

a base plate being fixed to the latch housing and extending vertically therefrom;

a closing lever pivotally mounted to the base plate and being supported by the latch housing, the closing lever having a first original position and a pressing portion, the pressing portion being engagable with the engagement portion of the latch lever to move the latch lever in a closing direction into a fully latched position in which the latch engages with the striker completely, the closing lever further comprising a contact portion and a stopper portion, the stopper portion contacting the base plate if malfunction occurs to prevent the closing lever from moving from the first original position in a direction opposite to the closing direction;

a spring having a first end secured to the latch housing, the spring further having a second end mounted to the closing lever, the spring being operable to enable the closing lever to return to the first original position by disengaging the pressing portion from the engagement portion of the latch lever;

a sector gear pivotally mounted to the base plate, the sector gear rotating around the pivot of the closing lever and moving the closing lever in the closing direction to enable the pressing portion to engage with the engagement portion of the latch lever, the sector gear having a second original position and a projection extending horizontally, the projection being engagable with the contact portion of the closing lever, the sector gear defining a vertical area and the pressing portion of the closing lever being positioned within the vertical area of the sector gear;

a pinion gear pivotally mounted to the base plate, the pinion gear being operable to mesh with the sector gear to reduce rotation of the sector gear, the pressing portion of the closing lever being disposed between the pinion gear and the pivot of the closing lever; and a motor connected to and driving the sector gear, wherein when the sector gear is rotated by a normal rotation of the motor, the projection of the sector gear engages the contact portion of the closing lever pressing the contact portion away from the spring and moving the closing lever from the first original position in the closing direction, and wherein when the sector gear is driven by a reverse rotation of the motor, the projection of the sector gear disengages from the contact portion and the sector gear returns to the second original position.

2. A door closing device according to claim 1 wherein the sector gear has the same axis as the closing lever.

* * * * *